US005228261A

United States Patent [19]

Watkins

[11] Patent Number: 5,228,261

[45] Date of Patent: Jul. 20, 1993

[54] FLOOR JOIST HANGER

[76] Inventor: Robert P. Watkins, 1140 E. 10th St., Fremont, Nebr. 68025

[21] Appl. No.: 775,770

[22] Filed: Oct. 15, 1991

[51] Int. Cl.[5] ..... E04B 1/38

[52] U.S. Cl. ..... 52/702; 52/289; 403/232.1

[58] Field of Search ..... 52/702, 255, 309.12, 52/289, 252; 403/232.1

[56] References Cited

U.S. PATENT DOCUMENTS

| | | | |
|---|---|---|---|
| 1,692,351 | 9/1927 | Ropp | 52/702 |
| 1,728,981 | 9/1929 | Ropp | 52/702 |
| 1,785,791 | 12/1930 | Ropp | 52/702 |
| 2,212,184 | 8/1940 | Powell | 52/702 |
| 3,837,135 | 9/1974 | Zachman | 52/702 |
| 5,061,111 | 10/1991 | Hosokawa | 403/232.1 |

FOREIGN PATENT DOCUMENTS

| | | | |
|---|---|---|---|
| 2611236 | 9/1977 | Fed. Rep. of Germany | 52/702 |

*Primary Examiner*—Richard E. Chilcot, Jr.
*Assistant Examiner*—Beth A. Aubrey
*Attorney, Agent, or Firm*—Zarley, McKee, Thomte, Voorhees & Sease

[57] ABSTRACT

A joist hanger includes a U-shaped body having a forward end and a rearward end. A plurality of nailing apertures are formed in the forward ends of legs of the U-shaped joist hanger for receiving nails therethrough to secure a joist thereto. A pair of support apertures are formed in the rearward ends of the legs through which conventional reinforcing bars are journaled in horizontal orientation. A slot extending forwardly from the rearward edge of the base of the U-shaped hanger will receive a vertically oriented reinforcing bar therein. A locating aperture is formed in each of the legs of the hanger and has a rod extending therethrough so as to contact the exterior face of a foam panel wall through which the joist hanger extends so as to locate the rearward end of the joist hanger at an appropriate position between foam panel wall forms.

7 Claims, 3 Drawing Sheets

FLOOR JOIST HANGER

TECHNICAL FIELD

The present invention relates generally to hangers for floor joists, and more particularly to an improved floor joist hanger for foam wall forming systems.

BACKGROUND OF THE INVENTION

Foam wall forming systems are a relatively recent development in the construction industry. These form systems replace the conventional wooden forms for retaining poured concrete to form a concrete wall. Typically, the wall forming system utilizes panels of polystyrene which are connected in parallel spaced-apart alignment by a series of ties between the panels. The panels may be formed of a variety of materials, but the preferred form is expanded polystyrene, which is a closed cell rigid lightweight cellular plastic which is highly insulative.

The upper and lower edges of the foam panels have castellations or tongue and groove formations along the upper, lower and opposing end edges of each panel which serve to lock the panels in vertical and horizontal edge-to-edge relationship. Steel reinforcing bars are conventionally inserted between the pairs of panels in vertical and horizontal relationship to strengthen the poured concrete. Once concrete is poured between the formed panels, the concrete will adhere to the panels and hold the panels in place on the hardened concrete wall. Thus, it can be seen that the panels of the prior art provide a form for pouring concrete, as well as insulating the wall once the concrete has hardened.

One problem which arises in utilizing foam wall forming systems is in the necessity of providing structure for supporting floor joists below the upper edge of the poured concrete wall. Conventionally it was necessary to scrape off a horizontal strip of foam panel to permit the installation of a wood plate which was bolted directly into the concrete. Floor joists could then be connected to the wood plate. This method for hanging floor joists was not only time consuming and labor-intensive, but did not leave a pleasing finished appearance.

It is therefore a general object of the present invention to provide an improved floor joist hanger for foam wall forming systems.

Another object of the present invention is to provide a floor joist hanger which mounts directly into the poured concrete of the concrete wall.

Still another object is to provide a floor joist hanger which does not require that foam panels be scraped away from the concrete wall to permit attachment of the hanger.

A further object of the present invention is to provide a floor joist hanger for foam wall forming systems which is simple to use, economical to manufacture and refined in appearance.

These and other objects of the invention will be apparent to those skilled in the art.

SUMMARY OF THE INVENTION

The joist hanger of the present invention is designed for use in a foam panel wall formed of a plurality of foam board panels stacked edge to edge. Two foam board panel walls are oriented in parallel spaced apart relation to provide forms for poured concrete. The joist hanger includes a U-shaped body inserted through a U-shaped aperture in one of the foam panel walls so as to have a forward end projecting exteriorly of the wall and a rearward end projecting interiorly between the foam panel walls. A plurality of nailing apertures are formed in the forward projecting end of legs of the U-shaped joist hanger for receiving nails therethrough to secure a joist on the forward end of the joist hanger. A pair of support apertures are formed in the rearward projecting ends of the legs through which conventional reinforcing bars are journaled in horizontal orientation. A slot extending forwardly from the rearward edge of the base of the U-shaped hanger will receive a vertically oriented reinforcing bar therein. Concrete poured between the foam panel walls will retain the joist hanger in permanent position A locating aperture is formed in each of the legs of the hanger and has a rod extending therethrough so as to contact the exterior face of the foam panel wall through which the joist hanger extends so as to locate the rearward end of the joist hanger at the appropriate position between the foam panel walls.

DESCRIPTION OF THE PREFERRED EMBODIMENT

Figure 1:
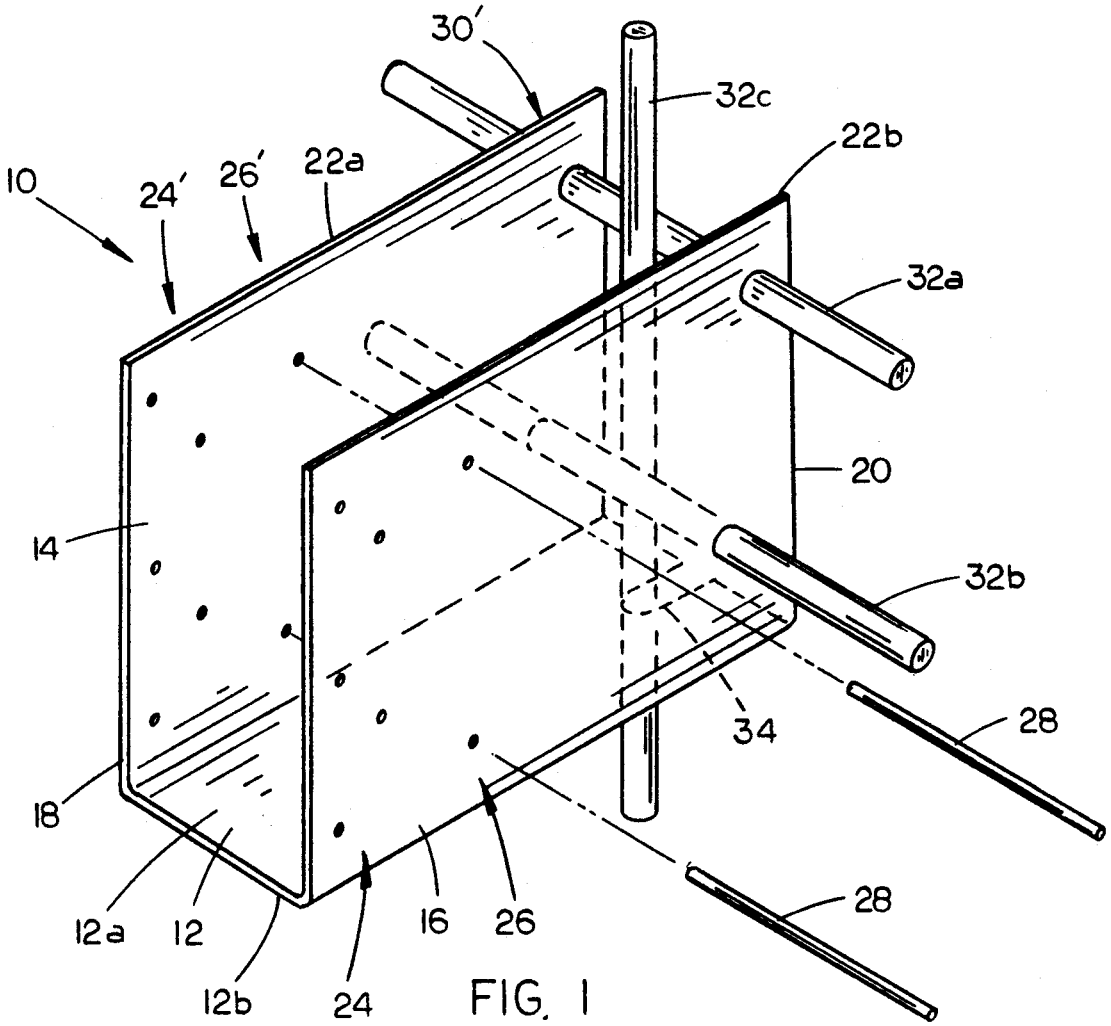
FIG. 1 is an enlarged perspective view of the floor joist hanger of the present invention.

Referring now to the drawings, in which similar or corresponding parts are identified with the same reference numeral, and more particularly to FIG. 1, the floor joist hanger of the present invention is designated generally at 10 and is preferably formed of a rigid metal material bent to form a generally U-shaped channel.

Hanger 10 includes a generally horizontal base 12 with a pair of upstanding legs 14 and 16 forming a generally U-shaped member. Hanger 10 includes a forward edge 18 a rearward edge 20 upper edges **22*a* and 22*b* at the upper ends of legs 14 and 16, respectively, and upper and lower surfaces 12*a* and 12*b* respectively of base 12**.

Figure 2:
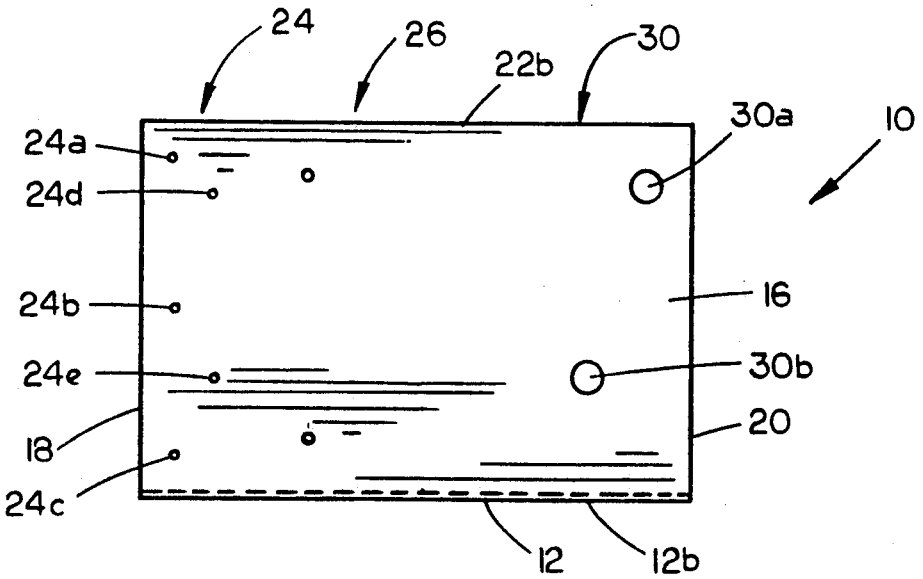
FIG. 2 is a side elevational view of the invention.
Figure 4:
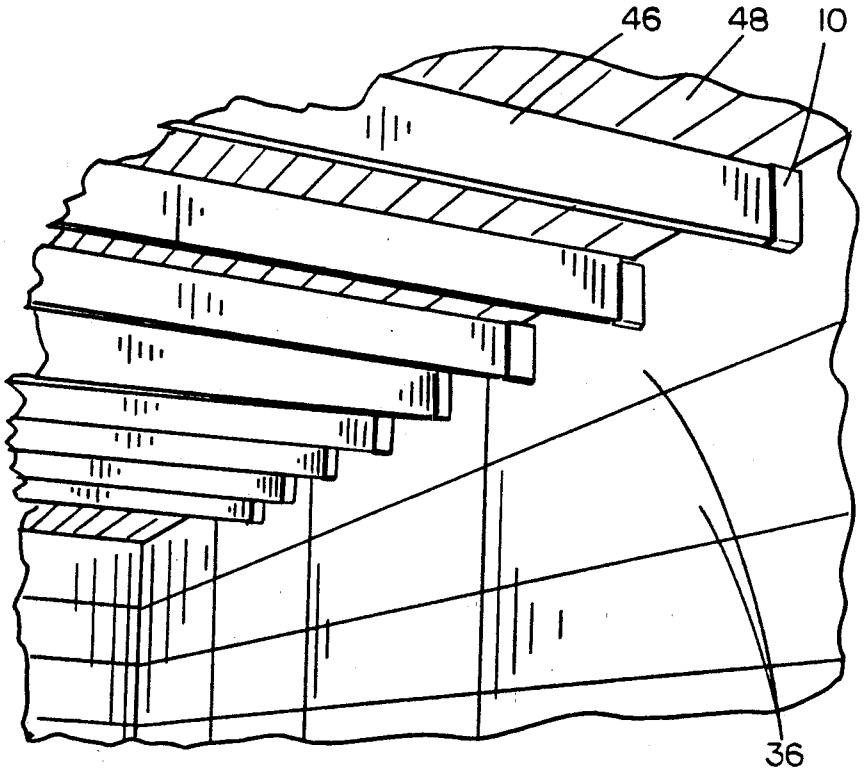
FIG. 4 is a perspective view of the foam wall forming system with the floor joist hangers mounted therein and joists mounted in the hangers.

Referring now to FIG. 2, three sets of apertures are formed in the leg 16 of hanger 10. The first set of apertures are nailing apertures 24 and are arranged in staggered formation adjacent the forward edge 18 of hanger 10. The hanger shown and described herein is designed for holding a joist up to 3½ inches wide, and is preferably approximately 7 inches in height and 9 inches in length. Nailing apertures 24 are preferably of the size to receive a **10*d* nail. Three nailing apertures 24*a*, *b* and *c* are aligned vertically approximately ½ inch from forward edge 18, with a second pair of apertures aligned vertically ⅞ inch rearwardly of the first three apertures, and staggered between the first three apertures. This arrangement permits effective nailing for secure fastening of the joists within hanger 10**.

A pair of locating apertures 26 are arranged in a vertical line approximately 2½ inches rearward of forward edge 18. Locating apertures 26 will receive an elongated rod 28 therethrough, for a purpose described in more detail hereinbelow.

A pair of support apertures 30 are located adjacent the rearward edge 20 of leg 16, and are of the size to support reinforces bars 32 (see FIG. 1) therethrough. Preferably, an upper aperture 30*a* is located ¾ inch from rearward edge 20 and 1 inch from upper edge 22*b*. A second aperture 30*b* is located approximately 2 inches from the lower edge of plate 16 and 1μ inches from rearward edge 20, so as to be in staggered arrangement with respect to aperture 30*a* and rearward edge 20. This spacing is designed to permit a vertically oriented reinforcing bar 32*c* to project vertically between reinforcing bars 32*a* and 32*b*, as shown in FIG. 1.

A slot 34 is cut forwardly into the center of rearward edge 20 of base 12, as shown in FIG. 1. The width of slot 34 is designed to receive a conventional reinforcing bar therethrough, and the slot preferably extends approximately 1¼ inches forwardly into base plate 12 such that reinforcing bar 32*c* may be aligned vertically between reinforcing bars 32*a* and 32*b*. An identical set of nailing apertures 24', locating apertures 26, and support apertures 30, are formed in leg 14 coaxial with apertures 24, 26 and 30 of leg 16.

Figure 3:
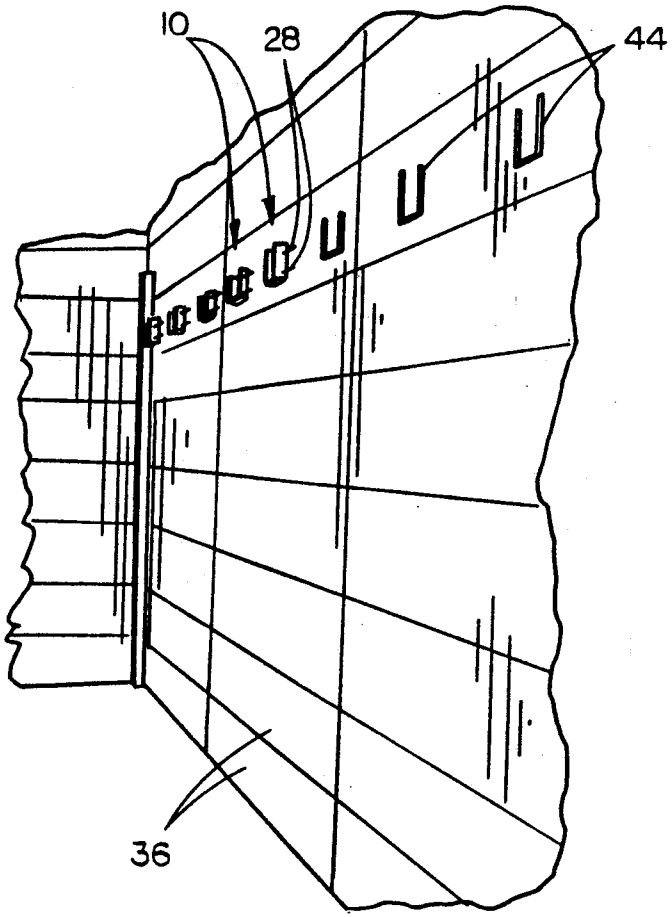
FIG. 3 is a perspective view of the foam wall forming system with a series of floor joist hanger of the present invention being installed therein.
Figure 5:
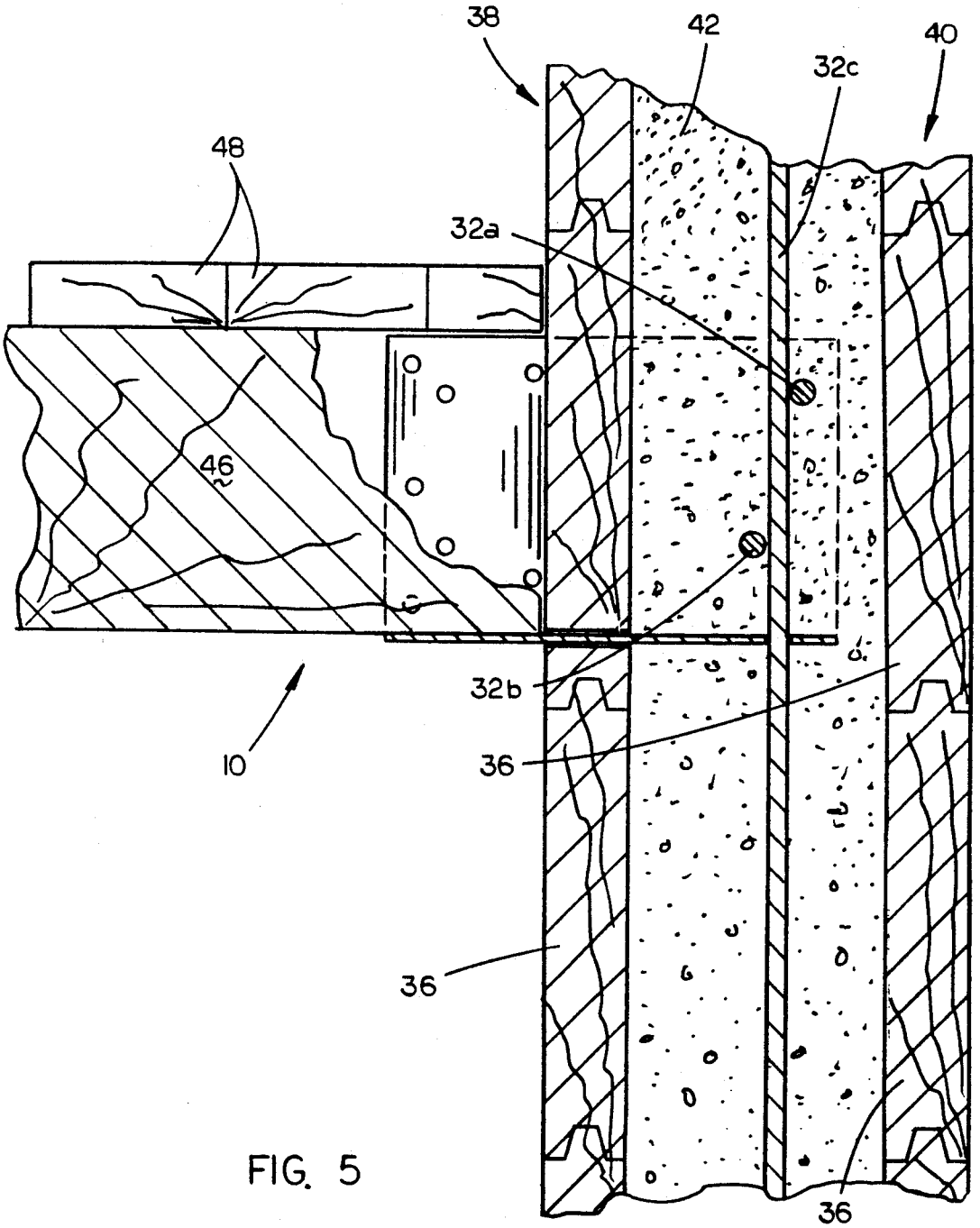
FIG. 5 is a vertical sectional view taken through a section of the foam wall forming system with the hanger and joists in place.

Referring now to FIGS. 3 and 5, a plurality of elongated rectangular foam panels 36 are connected to form an interior and exterior vertical foam wall 38 and 40 respectively. Foam walls 38 and 40 are used as concrete forms to retain poured concrete 42 therebetween.

Hangers 10 are installed during construction of the concrete wall 42, to provide rigid support for a joist. Initially, foam panel walls 38 and 40 are formed by stacking panels 36 and connecting them in uniform spaced parallel relation as shown in FIG. 5. U-shaped slots 44 are then cut into panels 36 in predetermined positions, as shown in FIG. 3. Rods 28 are loosely installed through locating apertures 26 and 26', and rearward edge 20 of each bracket 10 is then inserted into U-shaped slot 44 until rods 28 contact panel 36 (FIG. 3).

Reinforcing bars 32 are then positioned between foam panel walls 38 and 49 (see FIG. 5) and journaled through support apertures 30 and slot 34 at the rearward end of brackets 10. Concrete 42 is then poured between foam panel walls 38 and 40 and allowed to harden, thereby affixing reinforcing bars 32 and the rearward ends of hangers 10 in position within the wall. Rods 28 and then removed from locating apertures 26, and one end of a joist 46 is rested within the projecting forward end of brackets 10. Nails or other fasteners are then installed through nailing apertures 24 and/or 24' to affix joists 46 in position in hangers 10. Decking material 48 or the like may then be supported on joists 46.

Whereas the invention has been shown and described in connection with the preferred embodiment thereof, it will be understood that many modifications, substitutions and additions may be made which are within the intended broad scope of the appended claims. There has therefore been shown and described an improved floor joist hanger which accomplishes at least all of the above stated objects.

I claim:

1. A joist hanger comprising:

a rigid U-shaped body having a base and first and second upstanding legs;

said legs having a forward edge, a rearward edge, an upper edge, and a lower edge connected to side edges of the base;

said base having forward and rearward edges;

a plurality of nailing apertures formed adjacent the forward edges of said first and second legs, for receiving nails therethrough;

a first support aperture formed adjacent the rearward edges of each of said first and second legs, said first support apertures being coaxial and of a diameter to receive a conventional reinforcing bar therethrough;

said first support apertures spaced away from the edges of said legs;

a slot extending forwardly from the rearward edge of the base of a width to receive a conventional vertically oriented reinforcing bar therethrough but less than the distance between said legs.

2. A joist hanger comprising:

a rigid U-shaped body having a base and first and second upstanding legs;

said legs having a forward edge, a rearward edge, an upper edge, and a lower edge connected to side edges of the base;

said base having forward and rearward edges;

a plurality of nailing apertures formed adjacent the forward edges of said first and second legs, for receiving nails therethrough;

a first support aperture formed adjacent the rearward edges of each of said first and second legs, said first support apertures being coaxial and of a diameter to receive a conventional reinforcing bar therethrough;

a slot extending forwardly from the rearward edge of the base of a width to receive a conventional vertically oriented reinforcing bar therethrough;

a second support aperture formed adjacent the rearward edges of each said first and second leg, said second support apertures being coaxial and of a diameter to receive a conventional reinforcing bar therethrough;

said second support apertures spaced forwardly of said first support apertures a distance at least equal to the diameter of the second support apertures;

said second support apertures spaced vertically and forwardly with respect to said first support apertures; and said slot extending forwardly a distance to locate a vertically oriented reinforcing bar between said first and second support apertures.

3. The joist hanger of claim 1, further comprising a first locating aperture in each of said first and second legs, said first locating apertures being coaxial and located horizontally between said nailing apertures and said support apertures.

4. The joist hanger of claim 3, further comprising a second locating aperture in each of said first and second legs, said second locating apertures being coaxial and located vertically spaced and directly below said first locating apertures.

5. The joist hanger of claim 1, wherein said plurality of nailing apertures includes a first set of vertically aligned apertures and a second set of vertically aligned apertures, said first and second sets of apertures spaced horizontally apart and the apertures of said second set staggered with respect to the first set of apertures, for gang nailing.

6. In combination:

a first vertical wall formed of a plurality of foam board panels stacked edge-to-edge;

a second vertical wall formed of a plurality of foam board panels stacked edge-to-edge, parallel to the first wall and connected thereto to form forms for a poured concrete wall;

a plurality of U-shaped joist hangers mounted through U-shaped apertures in said first vertical wall, and having a forward end projecting exteriorly through said first wall for supporting a joist, and a rearward end projecting interiorly through said first wall between said first and second walls, for mounting within poured concrete between said first and second walls;

each said joist hanger having a base and first and second upstanding legs, and a forward edge and a rearward edge;

a plurality of nailing apertures formed in the forward projecting end of said legs of said joist hanger for receiving nails therethrough to secure a joist on the forward end of said joist hanger;

a first support aperture formed in the rearward projecting ends of said legs of said joist hanger, said first support apertures being coaxial;

an elongated horizontally oriented reinforcing bar extending through said first support apertures of said joist hangers;

a slot extending forwardly from the rearward edge of the base of each said joist hanger; and an elongated mounting bar extending vertically through each said slot.

7. The combination of claim 6, further comprising:

a locating aperture in each of said legs, said locating apertures being coaxial; and a rod extending through said locating apertures to contact said first wall and prevent rearward movement of the hanger through said U-shaped aperture beyond a predetermined position; and said locating apertures located a predetermined distance from the rearward edge of the hanger to cause the rearward end of the hanger to project a predetermined distance interiorly of the first wall.

* * * * *